362-111 SR
10/23/79 OR 4,172,274

United States Patent [19]

Zemke

[11] 4,172,274

[45] Oct. 23, 1979

[54] GUN BARREL BORE ILLUMINATOR

[76] Inventor: Alexander R. Zemke, 4725 S. Kolin Ave., Chicago, Ill. 60632

[21] Appl. No.: 912,368

[22] Filed: Jun. 5, 1978

Related U.S. Application Data

[63] Continuation-in-part of Ser. No. 799,667, May 23, 1977, abandoned.

[51] Int. Cl.[2] ..... F41G 1/34

[52] U.S. Cl. ..... 362/111; 362/205; 362/311

[58] Field of Search ..... 362/311, 202, 205, 110, 362/111

[56] References Cited

U.S. PATENT DOCUMENTS

| | | | |
|---|---|---|---|
| 1,490,272 | 4/1924 | Hickam | 362/111 |
| 3,240,924 | 3/1966 | Darby | 362/111 X |

*Primary Examiner*—Stephen J. Lechert, Jr.

[57] ABSTRACT

This invention relates to an improved construction for a gun barrel bore illuminator, which provides non-glare illumination for the interior of a gun barrel bore. The non-glare illumination facilitates visual inspection of the bore, allowing the inspector to look directly into the muzzle of the gun barrel. The illuminator includes an electric light bulb socket, adapted to be positioned in the breech end of the gun barrel. A light bulb is mounted in the electric light bulb socket to provide a light source. An electric power source is connected to the light bulb to cause the light bulb to emit light. A switch is interposed between the power source and the light bulb to control the electric power to the light bulb. A translucent light diffuser encloses the light bulb to diffuse the light from said light bulb along the bore to provide non-glare illumination of the bore.

9 Claims, 3 Drawing Figures

GUN BARREL BORE ILLUMINATOR

CROSS-REFERENCE TO RELATED APPLICATION

This is a continuation-in-part of Applicant's co-pending application Ser. No. 799,667, filed May 23, 1977, now abandoned.

BACKGROUND OF THE INVENTION

Persons who are interested in shooting and in guns generally find it desirable to inspect the condition of a gun barrel bore, especially bores having rifling, to determine the condition of the bore and to determine the cleanliness of the bore. A widely-accepted method of inspecting a rifle bore is to place a white patch at the end of the bore or even on a thumbnail, with light impinging on the patch or thumbnail, and to look down the bore from the muzzle end of the barrel to inspect the condition of the bore for cleanliness and for pits, scoring or other defects in the bore. Although this time-honored method has been widely used, persons who are familiar with the inspection of bores find that it is desirable to have a higher intensity of light in the bore in order to provide sufficient light for a careful inspection.

The patent art discloses an apparatus for providing light in the breech end of a barrel for illuminating a bore in U.S. Pat. No. 2,403,452. The illuminator in this instance is a piece of bent plastic material made of methyl methacrylate, which emits light along the device. The problem with a direct transmission of light is that the viewer has the light directed against the viewer's eye, thereby making it uncomfortable to inspect the bore and having a substantial amount of glare, which requires a long and tedious inspection in order to make the inspection carefully without missing a small pit in the bore, which may be the source of a problem. It is an object of this invention to provide a gun barrel bore illuminator which may be easily positioned in the breech of a gun and provides a virtually no-glare illumination for the bore. The construction of the present illuminator is an improvement on the flashlight attachment shown in U.S. Pat. No. 3,184,589.

SUMMARY OF THE INVENTION

The present invention is a gun barrel bore illuminator which provides non-glare illumination of the interior of a gun barrel for illumination of the bore. The illuminator is generally similar to a conventional flashlight arrangement, but with a generally U-shaped or J-shaped arrangement. The subject illuminator includes a tubular device for containing dry cells, with a conventional switch on the tubular device. The tubular device has an arm connected to one end substantially perpendicular to the length of the tube. The arm has connected to the other end thereof an electric light bulb socket, which socket extends outward from the arm in the same general direction as the tube. The electric light bulb socket is adapted to be positioned in the breech end of a gun barrel. A light bulb is mounted in the electric light bulb socket to provide a light source. The light bulb is connected to the dry cells in a conventional fashion so that the light bulb will emit light. A polystyrene light diffuser is mounted on the electric light bulb socket and encloses the light bulb so that all of the light emitted from the light bulb must pass through the diffuser before it is directed into the bore of the gun barrel, thereby diffusing the light and providing a nonglare source of illumination for the bore.

DESCRIPTION OF THE PREFERRED EMBODIMENT

Figure 3:
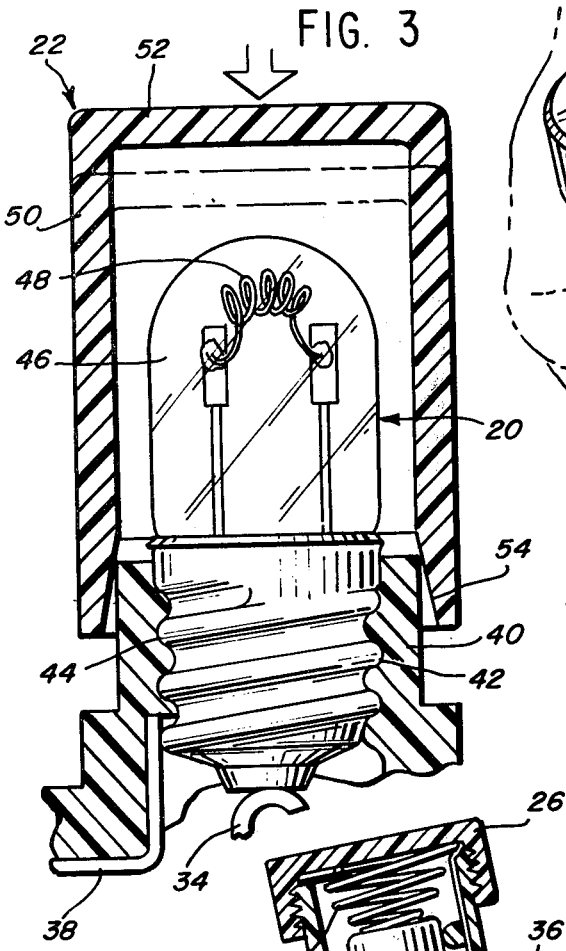
FIG 3 is an enlarged partial cross-sectional view of a portion of the illuminator of FIG. 1, showing a portion of an electric light bulb socket, with an electric light bulb mounted in the socket and a diffuser positioned in an attitude to be frictionally mounted on the socket, enclosing the electric light bulb.
Figure 1:
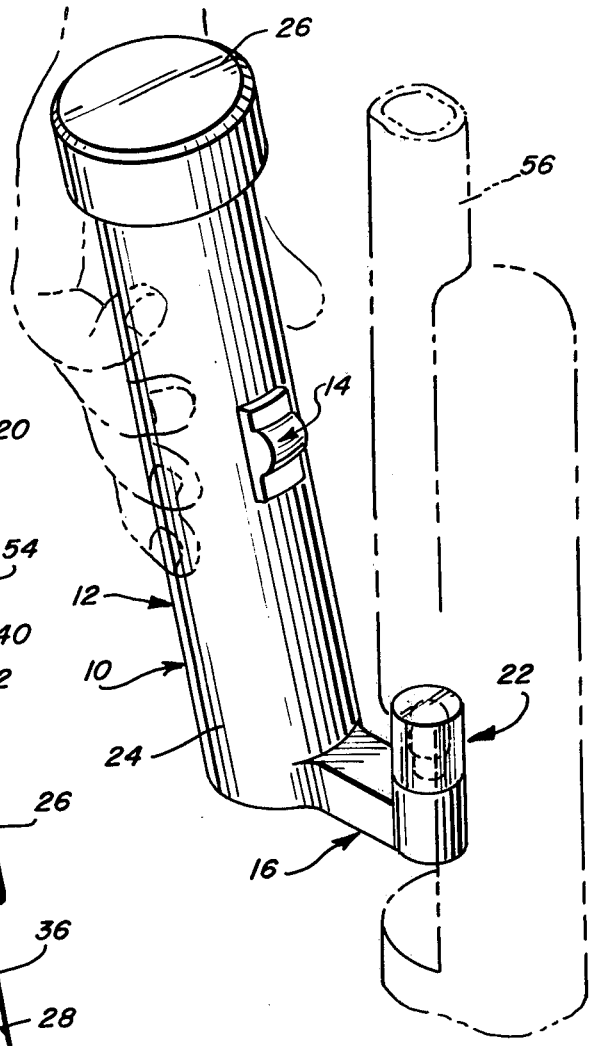
FIG. 1 is a perspective view of a gun barrel bore illuminator embodying the present invention, shown positioned in the breech end of a gun barrel, the gun barrel being shown in phantom.
Figure 2:
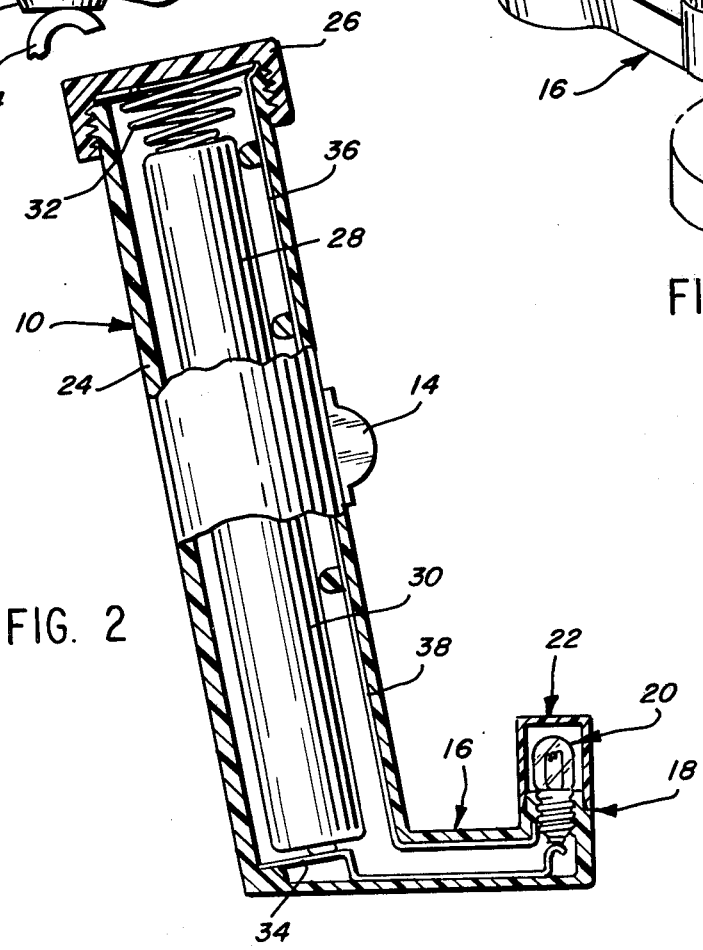
FIG. 2 is a partial cross-sectional view of the illuminator of FIG. 1, showing the interconnection of dry cells of a power source with a light bulb of the illuminator.

Referring now to the drawings, and especially to FIG. 2, an illuminator embodying the present invention, generally indicated by numeral 10, is shown therein. The illuminator 10 generally includes a power source 12, having a switch 14 connected thereto. A support arm 16 is connected at one end to one end of the power source, with an electric light bulb socket 18 connected to the other end of arm 16. An electric light bulb 20 is mounted in the socket 18. A light diffuser 22 is mounted on the socket 18, enclosing the electric light bulb 20.

The power source 12 is constructed in the same general fashion as a conventional flashlight, except for the connection to arm 16. The power source 12 includes a tube 24, which has an end cap 26 threadedly mounted on one end. A pair of conventional dry cells 28 and 30 is mounted in the tube 24, which provide a source of electrical energy of a predetermined voltage and current rating. The dry cells, in this instance, are size AA, providing a 1.5 volts. A conventional spring 32 is positioned in the tube and urges dry cell 30 into contact with a strap connector 34. The power source includes another strap connector 36, which is connected through switch 14 to a third strap connector 38.

The arm 16 is formed integral with one end of the tube 24, and has the strap connectors 34 and 38 extending therethrough. The arm has electric light bulb socket 18 formed integral with the other end of the arm. Socket 18 extends outward from the arm in the same direction as the tube 24 to form a general J-shaped construction for the illuminator.

The electric light bulb socket has a hollow cylindrical mounting support 40, which has an internal thread 42.

The electric light bulb 20 is a conventional electric light bulb in that it includes a threaded base 44, which is threadedly mounted in support 40, mating with internal thread 42. The threaded base has its exterior portion contacting the strap conductor 38; and, as is conventional, the base has a center portion contacting strap conductor 34. A glass envelope 46 is hermetically sealed on base 44. A conventional light emitter element 48 is positioned in the glass envelope.

The diffuser 22 is generally cup-shaped. The diffuser has a cylindrical side wall 50, with a top 52 formed integral with side wall 50. The side wall 50 has a tapered portion 54, adapted for frictional engagement with the upper and outer portion of support 40. The diffuser is made of a polystyrene, with a white pigment added, which white pigment is one of the well-known materials used for coloring polystyrene, such as titanium dioxide. The use of a white pigment produces a diffused white light, which has no glare. By experimental use of various thicknesses of material, it has been found that the optimum wall thickness of the side wall 50 and the top 52 is 1/16th of an inch. The diffuser is forced into frictional engagement with support 40. When it is necessary to change bulb 20, the diffuser may be readily disengaged and removed, exposing the bulb for ready replacement.

The illuminator is used in the following fashion. An operator grasps tube 24 in a conventional fashion and places the socket, with the light bulb and diffuser, in the breech end of a barrel, such as rifle barrel 56. Switch 14 is manipulated in order to provide a source of electric power to the light bulb, which causes the light bulb to emit light. The light emitted from the light is diffused through top 52 of the diffuser and side wall 50. The rifle barrel 56 is inspected by the inspector looking down the muzzle of the barrel toward the breech end. By virtue of the diffuser enclosing the light bulb 20, the inspector may look directly down the barrel toward the light bulb. In addition, the light bulb is completely enclosed in the diffuser so that there are no reflections from the side walls of the bore which have hot spots or glare areas which prevent the careful inspection of the bore.

Although a specific embodiment of the herein-disclosed invention has been described in detail, it is to be expressly understood that the instant invention is limited only by the appended claims.

What is claimed is:

1. A device for providing clear, non-glare illumination of the interior of a gun barrel for visual inspection of the bore of the gun barrel by looking directly into the muzzle of the gun barrel, comprising; an electric light bulb socket adapted to be positioned in the breech end of the gun barrel, a light bulb mounted in the electric light bulb socket to provide a light source, an electric power source of a predetermined voltage and current rating connected to said light bulb to cause said light bulb to emit light, a switch between the power source and the electric light bulb for selectively providing electric power to the light bulb to cause said light bulb to emit light selectively, and a translucent light diffuser enclosing said light bulb to diffuse the light from said light bulb along the gun bore to provide non-glare illumination of the gun bore.

2. A device for providing clear, non-glare illumination of the interior of a gun barrel for visual inspection of the bore of the gun barrel by looking directly into the muzzle of the gun barrel as defined in claim 1, wherein the electric power source includes a tube having dry cells inserted in the tube and being connected to the electric light bulb through the switch, said tube having an arm connected to one end and having the electric light bulb socket being mounted at the end of the arm, said electric light bulb socket extending outward from the arm in the same general direction as the tube, said electric light bulb socket having a circular cylindrical support adjacent to the electric light bulb, said diffuser having a circular cylindrical wall having a maximum thickness of 1/16th of an inch and a top fixed to the wall, said top having a maximum thickness of 1/16th of an inch, said cylindrical wall having an interiorly tapered portion frictionally engaging the support of the electric light bulb socket, and said diffuser being a polystyrene plastic having a white pigment.

3. A device for providing clear, non-glare illumination of the interior of a gun barrel for visual inspection of the bore of the gun barrel by looking directly into the muzzle of the gun barrel as defined in claim 1, wherein the diffuser is made of polystyrene.

4. A device for providing clear, non-glare illumination of the interior of a gun barrel for visual inspection of the bore of the gun barrel by looking directly into the muzzle of the gun barrel as defined in claim 1, wherein the diffuser is made of polystyrene having a white pigment to produce a diffused, non-glare white light.

5. A device for providing clear, non-glare illumination of the interior of a gun barrel for visual inspection of the bore of the gun barrel by looking directly into the muzzle of the gun barrel is defined in claim 1, wherein the diffuser is a cylindrical cup connected to the electric light bulb socket.

6. A device for providing clear, non-glare illumination of the interior of a gun barrel for visual inspection of the bore of the gun barrel by looking directly into the muzzle of the gun barrel as defined in claim 1, wherein a portion of the electric light bulb socket adjacent to the electric light bulb is a circular cylinder and said diffuser is a cylindrical cup having a cylindrical wall interiorly tapered and in frictional engagement with the socket for holding the cup on the socket.

7. A device for providing clear, non-glare illumination of the interior of a gun barrel for visual inspection of the bore of the gun barrel by looking directly into the muzzle of the gun barrel as defined in claim 1, wherein the diffuser is a cylindrical cup made of polystyrene material and the cup is connected to and supported by the electric light bulb socket.

8. A device for providing clear, non-glare illumination of the interior of a gun barrel for visual inspection of the bore of the gun barrel by looking directly into the muzzle of the gun barrel as defined in claim 1, wherein the diffuser is a cylindrical cup connected to and supported by the electric light bulb socket, said cylindrical cup being a polystyrene material having a white pigment.

9. A device for providing a clear, non-glare illumination of the interior of a gun barrel for visual inspection of the bore of the gun barrel by looking directly into the muzzle of the gun barrel as defined in claim 1, wherein the diffuser is a cup having a circular cylindrical wall having a maximum thickness of 1/16th of an inch and a top fixed to the cylindrical wall having a thickness of 1/16th of an inch, said cup being connected to and supported by the electric light bulb socket, said cup being a polystyrene material having a white pigment.

* * * * *